US006691870B1

(12) United States Patent
Palm et al.

(10) Patent No.: US 6,691,870 B1
(45) Date of Patent: Feb. 17, 2004

(54) BLISTER BOX PACK FOR SENSITIVE PACKAGED GOODS WITH HIGHLY VOLATILE AND/OR MOISTURE SENSITIVE COMPONENTS

(75) Inventors: Detlef Palm, Ochtendung (DE); Peter Schwarz, Konigswinter (DE)

(73) Assignee: LTS Lohmann Therapie-Systeme AG, Andernach (DE)

( * ) Notice: Subject to any disclaimer, the term of this patent is extended or adjusted under 35 U.S.C. 154(b) by 0 days.

(21) Appl. No.: 10/030,289

(22) PCT Filed: Jun. 29, 2000

(86) PCT No.: PCT/EP00/06054

§ 371 (c)(1),
(2), (4) Date: Apr. 11, 2002

(87) PCT Pub. No.: WO01/04019

PCT Pub. Date: Jan. 18, 2001

(30) Foreign Application Priority Data

Jul. 7, 1999 (DE) ..... 199 31 364

(51) Int. Cl.[7] ..... B65D 81/24
(52) U.S. Cl. ..... 206/462; 206/461
(58) Field of Search ..... 206/461, 469, 206/528, 531, 532, 534, 538, 539, 462

(56) References Cited

U.S. PATENT DOCUMENTS 3,129,817 A 4/1964 Rohdin
3,912,082 A * 10/1975 Gerner et al. ..... 206/531
4,429,792 A 2/1984 Machbitz
5,172,812 A 12/1992 Wharton et al.
5,339,960 A * 8/1994 Price ..... 206/531
5,803,248 A 9/1998 Cox

FOREIGN PATENT DOCUMENTS

| | | |
|---|---|---|
| DE | 87 04 853.1 | 7/1987 |
| EP | 0 765 741 A | 4/1997 |
| EP | 0 771 737 A | 5/1997 |
| FR | 2 772 772 A | 6/1999 |
| GB | 2 218 072 A | 11/1989 |
| WO | 98/54068 | 12/1998 |

* cited by examiner

*Primary Examiner*—Jim Foster
(74) *Attorney, Agent, or Firm*—Birch, Stewart, Kolasch & Birch, LLP

(57) ABSTRACT

A blister cardboard pack for sensitive goods to be packaged comprising readily volatile and/or moisture-sensitive components, in a configuration preventing the entrance of moisture and/or the escape of volatile components, comprising a blister card (1), which in a manner known per se is configured either as one piece or, e.g. as a folding card (1, 1'), in two pieces, as a carrier for a blister cap (2) of transparent material containing the goods to be packaged, which blister card (1) and blister cap (2) are connected to each other by at least one sealing lacquer film (3, 3'), characterized in that between the blister card (1) and the blister cap (2) there is arranged a barrier layer (4) which is impermeable to water vapour and/or volatile components and which is connected in a media-tight manner, on the one hand, to the blister card (1) and, on the other hand, to the blister cap (2) by means of at least one sealing lacquer pressure-sensitive adhesive film (3, 3').

6 Claims, 2 Drawing Sheets

BLISTER BOX PACK FOR SENSITIVE PACKAGED GOODS WITH HIGHLY VOLATILE AND/OR MOISTURE SENSITIVE COMPONENTS

This application is the national phase under 35 U.S.C. §371 of PCT International Application No. PCT/EP00/06054 which has an International filing date of Jun. 29, 2000, which designated the United States of America.

This invention relates to a blister cardboard packs for sensitive goods to be packaged, which goods comprise readily volatile and/or moisture-sensitive components, said blister cardboard pack being of a configuration preventing moisture from entering it and/or volatile components from escaping therefrom and comprising a blister card which in a manner known per se is either configured in one piece or, e.g. as a folding card, in two pieces, and which serves as a carrier for a blister cap which is of transparent material and contains the goods to be packaged, said blister card and said blister cap being connected to each other by at least one film of sealing lacquer.

Blister packs of numerous configurations have been known for a long time. In commerce, so-called tablet blister packs for tablets or capsules are most frequent, these are comprised of a thermoformed blister having a plurality of receiving troughs of transparent material, and of a rear side of aluminium foil. They are especially suitable for administration forms which are taken, for example, once or several times a day over a prolonged period of treatment. The medicaments are withdrawn by pressing them through the aluminium foil, which can be made to burst already at a slight pressure. Such packages are, however, unsuited for larger objects to be packaged.

In addition, blister cardboard packs are known which consist of a thermoformed blister in the form of a cap of transparent material whose size is adapted to the goods to be packaged, and which are equipped with a cardboard as a rear side. Such blister cardboard packs are, however, unsuitable for sensitive goods to be packaged which comprise readily volatile and/or moisture-sensitive components. This is because the cardboard rear side possesses a high water vapour permeability of about 10 g $H_2O/m^2 \times h$, so that such packages are not capable of effectively protecting the goods contained therein against external influences or loss of active substance during storage.

It is the object of the present invention to provide a blister cardboard pack for sensitive goods to be packaged, said goods comprising readily volatile and/or moisture-sensitive components, which blister cardboard pack prevents the said volatile ingredients, especially any volatile active substance components, from escaping therefrom, and/or any substance-changing moisture from entering. In addition, the novel pack is to be uncomplicated and suited for use in common packaging devices.

This object is solved, in a blister cardboard pack of the kind mentioned in the introductory part of claim 1, by means of the invention in that between the blister card and the blister cap there is arranged a barrier layer which is water vapour impermeable and/or impermeable to volatile components and which is connected in a media-tight manner, on the one hand, to the blister card and, on the other hand, to the blister cap by means of at least one pressure-sensitive adhesive film of sealing lacquer.

To achieve this object in a blister cardboard pack of the afore-mentioned kind for sensitive goods to be packaged which comprise readily volatile and/or moisture-sensitive components, it is proposed by the invention that a barrier layer which is impermeable to water vapour and/or to volatile components be arranged between the blister card and the blister cap, and that the barrier layer is connected in a media-tight manner, on the hand, to the blister card and, on the other hand, to the blister cap by means of at least one sealed-margin bag lacquer pressure-sensitive film.

By way of the inventive construction of the blister cardboard pack, there is provided, in a surprisingly uncomplicated and effective manner, a packaging system for sensitive goods to be packaged which has a considerable protective factor for readily volatile and/or moisture-sensitive ingredients and which can be readily processed on an industrial scale using common packaging devices.

One embodiment of the blister cardboard pack provides, according to the invention, that the barrier layer is a plastics film which possesses a sufficient barrier function against water vapour and readily volatile components.

Another embodiment provides for the barrier layer to be an aluminium foil which is laminated onto the blister card.

A further useful and very economic embodiment of the invention provides for the barrier layer to be made of an impregnating layer at least of the blister card surface facing the blister cap, which impregnating layer has satisfactory barrier characteristics against water vapour and volatile substances.

Finally, according to the invention, the measure may be taken to provide the impregnating layer in the form of a pore-closing cover layer of an impermeable printing medium, which cover layer is preferably capable of being applied in a printing method.

The blister card according to the present invention advantageously enables presentation of products in the sales shelf in a suspended manner. By contrast to other, conventional blister packs, the blister card according to the invention makes it possible to provide additional product information by printing on the aluminium foil.

Further details, features and advantages of the invention will become apparent from the following illustration of an example of an embodiment represented schematically in the drawings.

Figure 1:
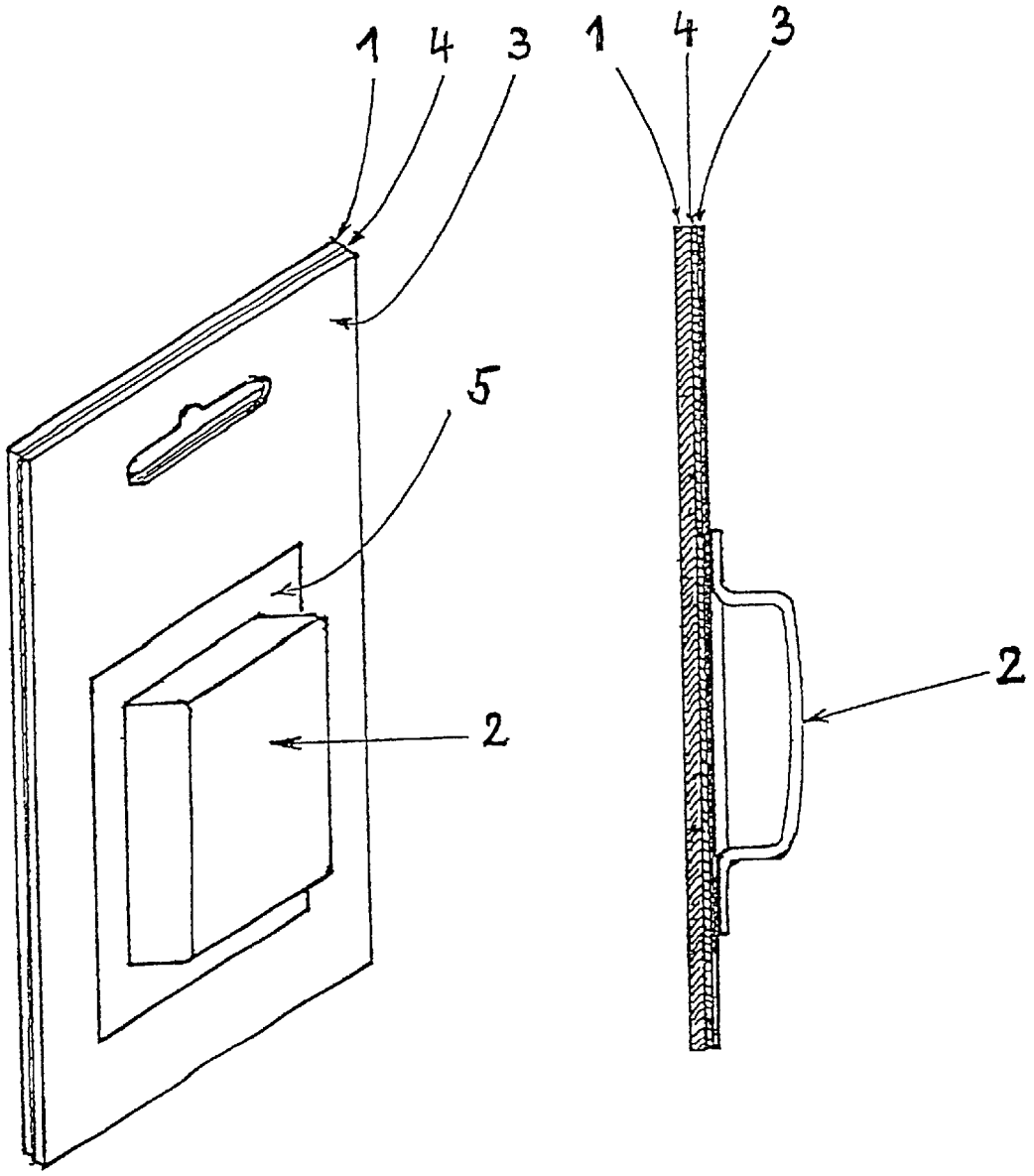
FIG. 1 shows, once in cross-section and, opposite, in perspective view, a blister cardboard pack according to the invention for sensitive goods to be packaged.

The cardboard blister pack shown in FIG. 1 for sensitive goods to be packaged comprising readily volatile and/or moisture-sensitive components, which is of a construction preventing moisture from entering it and/or volatile components from escaping therefrom and which comprises a blister card 1 as carrier of a blister cap 2, which blister card 1, in a manner known per se, is configured either as one piece or, e.g. as a folding card 1, 1' (FIG. 2), in two pieces, and which blister cap 2 contains the packaged goods and is made of transparent material, said blister card 1 and said blister cap 2 being connected to each other by means of at least one sealing lacquer film 3, 3', is characterized in that between the blister card 1 and the blister cap 2 there is arranged a barrier layer 4 which is impermeable to water vapour and volatile components and which is connected in a media-tight manner, on the one hand, with the blister card 1 and, on the other hand, with the blister cap 2 by means of at least one sealing lacquer pressure-sensitive film 3. Here the measure may be taken for the barrier layer 4, e.g. an aluminium foil, to be laminated in a media-tight manner known to those skilled in the art onto the blister card 1, which is made of cardboard. A sealing lacquer film 3 is applied to the barrier layer 4 thus obtained, likewise in a manner known to those skilled in the art, and the blister cap 2 is sealed thereon with its flange-like margins 5 employing, for example, the heat sealing method.

This results in a package impermeable to vapour and volatile components of the ingredients which is uncomplicated and can be manufactured with conventional automatic packaging machines.

Figure 2:
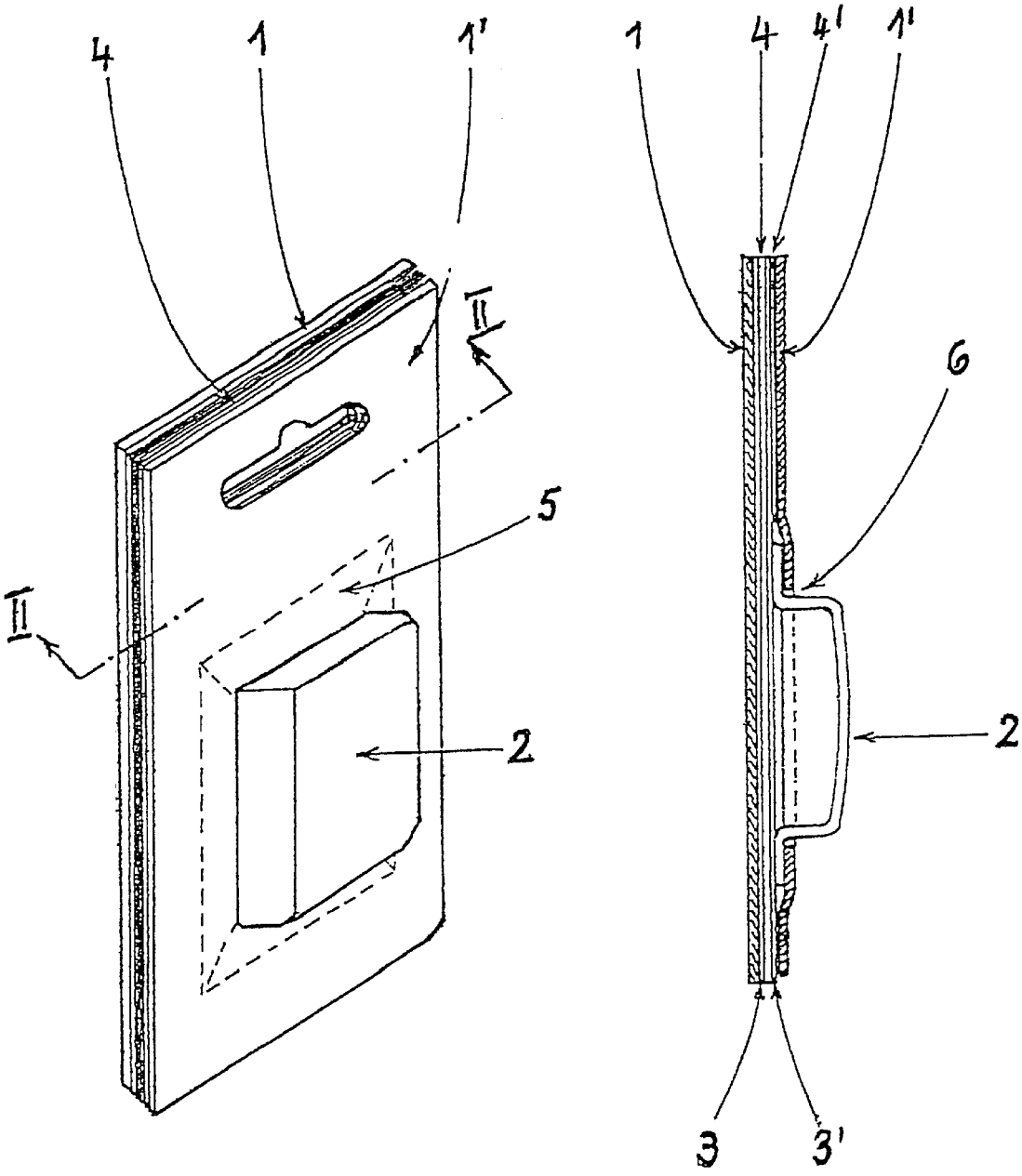
FIG. 2 shows, in cross-section and in perspective view, a further embodiment of the blister pack according to the invention.

FIG. 2, however, shows a somewhat different embodiment of the blister cardboard pack according to the invention comprising a folding card 1, 1'. The front side 1' thereof has a cut-out 6 in the manner of a window by means of which the blister cap 2, which extends through the cut-out and, with its lateral flanges 5, behind the same, is configured to yield a media-tight packaging system by sealing the sealing layers 3, 3' with the centrally arranged barrier layer 4.

In this embodiment too, the barrier layer 4 may be a plastics film having sufficient barrier capacity against water vapour and volatile ingredients, or an aluminium foil laminated to the blister card 1.

The barrier layer 4 may, however, also consist of an impregnating layer 4' at least of the surface of the blister card 1 facing the blister cap 2, which impregnating layer 4' has sufficient barrier capacity against water vapour and volatile substances. Finally, with advantage for a very economic manufacture, the measure may be taken for the impregnating layer 4' to be a pore-closing cover layer of an impermeable printing medium, which cover layer is preferably applicable by a printing method.

The blister cardboard pack according to the invention realizes a safe packaging system for sensitive goods to be packaged comprising readily volatile and/or moisture-sensitive components, in a configuration preventing the entrance of moisture and/or the escape of volatile components, and thus optimally solves the task posed at the beginning.

What is claimed is:

1. Blister cardboard pack for sensitive goods to be packaged comprising readily volatile and/or moisture-sensitive components, in a configuration preventing the entrance of moisture and/or the escape of volatile components, comprising a blister card (1), which in a manner known per se is configured either as one piece or, e.g. as a folding card (1, 1'), in two pieces, as a carrier for a blister cap (2) of transparent material containing the goods to be packaged, which blister card (1) and blister cap (2) are connected to each other by at least one sealing lacquer film (3, 3'), characterized in that between the blister card (1) and the blister cap (2) there is arranged a barrier layer (4) which is impermeable to water vapour and/or volatile components and which is connected in a media-tight manner, on the one hand, to the blister card (1) and, on the other hand, to the blister cap (2) by means of at least one sealing lacquer pressure-sensitive adhesive film (3, 3').

2. Blister cardboard pack according to claim 1, characterized in that the barrier layer (4) is a plastics film having sufficient barrier capacity against water vapour and volatile ingredients.

3. Blister cardboard pack according to claim 1, characterized in that the barrier layer (4) is an aluminium foil laminated to the blister card (1).

4. Blister cardboard pack according to claim 1, characterized in that the barrier layer (4) is comprised of an impregnating layer (4') at least of the blister cap (2)-facing surface of the blister card (1), which impregnating layer (4') has a satisfactory barrier capacity against water vapour and volatile substances.

5. Blister cardboard pack according to claim 4, characterized in that the impregnating layer (4') is a pore-closing cover layer of an impermeable printing medium, which cover layer is preferably applicable using a printing method.

6. Blister cardboard pack according to claim 3, characterized in that product information is applied by printing on the aluminium foil.

* * * * *